US011727863B2

(12) United States Patent
An et al.

(10) Patent No.: US 11,727,863 B2
(45) Date of Patent: Aug. 15, 2023

(54) DISPLAY DEVICE WHICH SENSES AND COMPENSATES FOR DEGRADATION OF A PIXEL AND METHOD OF DRIVING DISPLAY DEVICE

(71) Applicant: Samsung Display Co., Ltd., Yongin-si (KR)

(72) Inventors: Boyoung An, Hwaseong-si (KR); Ji-Woong Jeong, Hwaseong-si (KR); Wook Lee, Hwaseong-si (KR); Jungki Min, Seongnam-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/732,375

(22) Filed: Apr. 28, 2022

(65) Prior Publication Data

US 2023/0047875 A1 Feb. 16, 2023

(30) Foreign Application Priority Data

Aug. 13, 2021 (KR) ..... 10-2021-0107252

(51) Int. Cl.
*G09G 3/32* (2016.01)

(52) U.S. Cl.
CPC ..... *G09G 3/32* (2013.01); *G09G 2300/043* (2013.01); *G09G 2300/0842* (2013.01); *G09G 2320/041* (2013.01); *G09G 2320/045* (2013.01)

(58) Field of Classification Search
CPC ... G09G 3/32–3291; G09G 2300/0413; G09G 2300/0421–043; G09G 2300/0842;
(Continued)

(56) References Cited

U.S. PATENT DOCUMENTS 7,199,771 B2 4/2007 Yamazaki et al.
8,558,767 B2 10/2013 Kwon
(Continued)

FOREIGN PATENT DOCUMENTS

KR 10-2014-0078504 6/2014
KR 10-2017-0072420 6/2017
(Continued)

*Primary Examiner* — Nathan Danielsen
(74) *Attorney, Agent, or Firm* — H.C. Park & Associates, PLC

(57) ABSTRACT

A display device including pixels; a controller configured to generate first compensation data based on first sensing data with respect to threshold voltages of driving transistors of the pixels which are sensed during a first sensing period, to generate second compensation data based on second sensing data with respect to mobilities of the driving transistors of the pixels which are sensed during the first sensing period, to generate third compensation data based on third sensing data with respect to mobility change amounts of the driving transistors of the pixels which are sensed using image data for sensing compensated based on the first and second compensation data during a second sensing period, and to compensate input image data based on the first, second, and third compensation data to generate compensated image data; and a data driver configured to provide data voltages to the pixels based on the compensated image data.

15 Claims, 13 Drawing Sheets

(58) Field of Classification Search
CPC ..... G09G 2310/0243; G09G 2310/027–0275; G09G 2310/06; G09G 2310/08; G09G 2320/0233; G09G 2320/0242; G09G 2320/04–045; G09G 2320/0693
See application file for complete search history.

(56) References Cited

U.S. PATENT DOCUMENTS

| | | | | |
|---|---|---|---|---|
| 9,922,598 | B2 | 3/2018 | Park et al. | |
| 2011/0164071 | A1* | 7/2011 | Chung | G09G 3/3233 315/291 |
| 2013/0147693 | A1* | 6/2013 | Bae | G09G 3/3225 345/82 |
| 2013/0169699 | A1* | 7/2013 | Jeong | G09G 3/3225 345/690 |
| 2018/0174512 | A1* | 6/2018 | Yuan | G09G 3/3258 |
| 2019/0108792 | A1* | 4/2019 | Hwang | G09G 3/3233 |
| 2020/0105190 | A1* | 4/2020 | Tang | G09G 3/3225 |
| 2020/0234644 | A1* | 7/2020 | Li | G09G 3/3233 |
| 2021/0202673 | A1* | 7/2021 | Kim | G09G 3/3233 |

FOREIGN PATENT DOCUMENTS

| | | |
|---|---|---|
| KR | 10-2019-0014850 | 2/2019 |
| KR | 10-2020-0046753 | 5/2020 |

* cited by examiner

DISPLAY DEVICE WHICH SENSES AND COMPENSATES FOR DEGRADATION OF A PIXEL AND METHOD OF DRIVING DISPLAY DEVICE

CROSS-REFERENCE TO RELATED APPLICATION

This application claims priority under 35 USC § 119 to Korean Patent Application No. 10-2021-0107252 filed on Aug. 13, 2021 in the Korean Intellectual Property Office (KIPO), the entire disclosure of which is incorporated by reference herein.

BACKGROUND

1. Field

Embodiments relate to a display device. More particularly, embodiments relate to a display device applied to various electronic apparatuses and a method of driving the display device.

2. Description of the Related Art

A display device may include pixels emitting light for image display. Each of the pixels may include a driving transistor that generates a driving current and a light emitting diode that emits light based on the driving current.

Characteristics (e.g., threshold voltage, mobility, etc.) of the driving transistor may change according to process deviation in the manufacturing process of the display device, degradation of the pixel in the driving process of the display device, or the like. In order to compensate the characteristic change of the driving transistor, a compensation transistor for compensating the characteristic of the driving transistor may be added inside the pixel, or image data applied to the pixel may be compensated outside the pixel.

SUMMARY

Embodiments provide a display device for correctly sensing information on degradation of a pixel and for compensating the degradation of the pixel.

Embodiments provide a method of driving a display device for correctly sensing information on degradation of a pixel and for compensating the degradation of the pixel.

A display device according to an embodiment may include: a display panel including pixels; a controller configured to generate first compensation data based on first sensing data with respect to threshold voltages of driving transistors of the pixels which are sensed during a first sensing period after a power-off of the display device, to generate second compensation data based on second sensing data with respect to mobilities of the driving transistors of the pixels which are sensed during the first sensing period, to generate third compensation data based on third sensing data with respect to mobility change amounts of the driving transistors of the pixels which are sensed using image data for sensing compensated based on the first compensation data and the second compensation data during a second sensing period during an image display of the display device, and to compensate input image data based on the first compensation data, the second compensation data, and the third compensation data to generate compensated image data; and a data driver configured to provide a data voltage to each of the pixels based on the compensated image data.

In an embodiment, the mobilities of the driving transistors of the pixels which are sensed during the first sensing period may be sensed using the image data for sensing compensated based on the first compensation data.

In an embodiment, the controller may include: a first compensator configured to generate the first compensation data based on the first sensing data; a second compensator configured to generate the second compensation data based on the second sensing data; a third compensator configured to generate the third compensation data based on the third sensing data; and an image data compensator configured to compensate the image data for sensing based on the first compensation data and the second compensation data, and to compensate the input image data based on the first compensation data, the second compensation data, and the third compensation data.

In an embodiment, the third compensator may include: a compensation target selector configured to select a compensation target; a compensation data generator configured to generate the third compensation data based on the third sensing data and the compensation target; and a compensation data controller configured to control the third compensation data based on a parameter.

In an embodiment, the compensation target selector may be configured to select one of a representative value of the second sensing data, a representative value of the third sensing data, and a representative value of fourth sensing data with respect to the mobilities of the driving transistors of the pixels which are sensed using the image data for sensing during a third sensing period after a power-on of the display device as the compensation target.

In an embodiment, the compensation target selector may be configured to gradually change the compensation target from a first voltage level to a second voltage level in a predetermined transition time when the compensation target changes from the first voltage level to the second voltage level.

In an embodiment, the compensation data controller may be configured to multiply gains of the third compensation data by a panel parameter determined according to a size of the display panel.

In an embodiment, the compensation data controller may be configured to multiply gains of the third compensation data by a temperature parameter determined according to a temperature of the display panel.

In an embodiment, the compensation data controller may be configured to multiply gains of the third compensation data by a grayscale parameter determined according to grayscales of the input image data.

In an embodiment, the display device may further include: a sensing driver configured to provide the first sensing data, the second sensing data, and the third sensing data to the controller based on a sensing voltage receiving from each of the pixels.

In an embodiment, the display device may further include: a scan driver configured to provide a first scan signal and a second scan signal to each of the pixels.

In an embodiment, each of the pixels may include: a switching transistor configured to transmit the data voltage from the data driver in response to the first scan signal; a driving transistor configured to generate a driving current based on the data voltage; a storage capacitor configured to store the data voltage; a light emitting diode configured to emit light based on the driving current; and a sensing transistor configured to transmit the sensing voltage to the sensing driver in response to the second scan signal.

A method of driving a display device according to an embodiment may include: generating first compensation data based on first sensing data with respect to threshold voltages of driving transistors of the pixels which are sensed during a first sensing period after a power-off of the display device; generating second compensation data based on second sensing data with respect to mobilities of the driving transistors of the pixels which are sensed during the first sensing period; generating third compensation data based on third sensing data with respect to mobility change amounts of the driving transistors of the pixels which are sensed using image data for sensing compensated based on the first compensation data and the second compensation data during a second sensing period during an image display of the display device; compensating input image data based on the first compensation data, the second compensation data, and the third compensation data to generate compensated image data; and providing data voltages to the pixels based on the compensated image data.

In an embodiment, the mobilities of the driving transistors of the pixels which are sensed during the first sensing period may be sensed using the image data for sensing compensated based on the first compensation data.

In an embodiment, generating the third compensation data may include: selecting a compensation target; generating the third compensation data based on the third sensing data and the compensation target; and controlling the third compensation data based on a parameter.

In an embodiment, selecting the compensation target may include: selecting one of a representative value of the second sensing data, a representative value of the third sensing data, and a representative value of fourth sensing data with respect to the mobilities of the driving transistors of the pixels which are sensed using the image data for sensing during a third sensing period after a power-on of the display device as the compensation target.

In an embodiment, selecting the compensation target may include: gradually changing the compensation target from a first voltage level to a second voltage level in a predetermined transition time when the compensation target changes from the first voltage level to the second voltage level.

In an embodiment, controlling the third compensation data may include: multiplying gains of the third compensation data by a panel parameter determined according to a size of the display device.

In an embodiment, controlling the third compensation data may include: multiplying gains of the third compensation data by a temperature parameter determined according to a temperature of the display device.

In an embodiment, controlling the third compensation data may include: multiply gains of the third compensation data by a grayscale parameter determined according to grayscales of the input image data.

In the display device and the method of driving the display device according to the embodiments, the first compensation data for compensating degraded threshold voltages of the driving transistors and the second compensation data for compensating degraded mobilities of the driving transistors may be generated based on the first sensing data with respect to the threshold voltages of the driving transistors which are sensed during the first sensing period and the second sensing data with respect to the mobilities of the driving transistors which are sensed during the first sensing period, and the third compensation data for compensating the mobility change amounts of the driving transistors may be generated based on the third sensing data with respect to the mobility change amounts of the driving transistor which are sensed using the image data for sensing compensated based on the first compensation data and the second compensation data during the second sensing period, so that the mobility change amounts of the driving transistors during the image display may be accurately sensed. Further, the input image data may be compensated based on the first compensation data, the second compensation data, and the third compensation data to generate the compensated image data, so that the threshold voltages and the mobilities of the driving transistors may be accurately compensated.

BRIEF DESCRIPTION OF THE DRAWINGS

Illustrative, non-limiting embodiments will be more clearly understood from the following detailed description taken in conjunction with the accompanying drawings.

DETAILED DESCRIPTION OF THE EMBODIMENTS

Hereinafter, display devices and methods of driving display devices in accordance with embodiments will be explained in detail with reference to the accompanying drawings.

Figure 1:
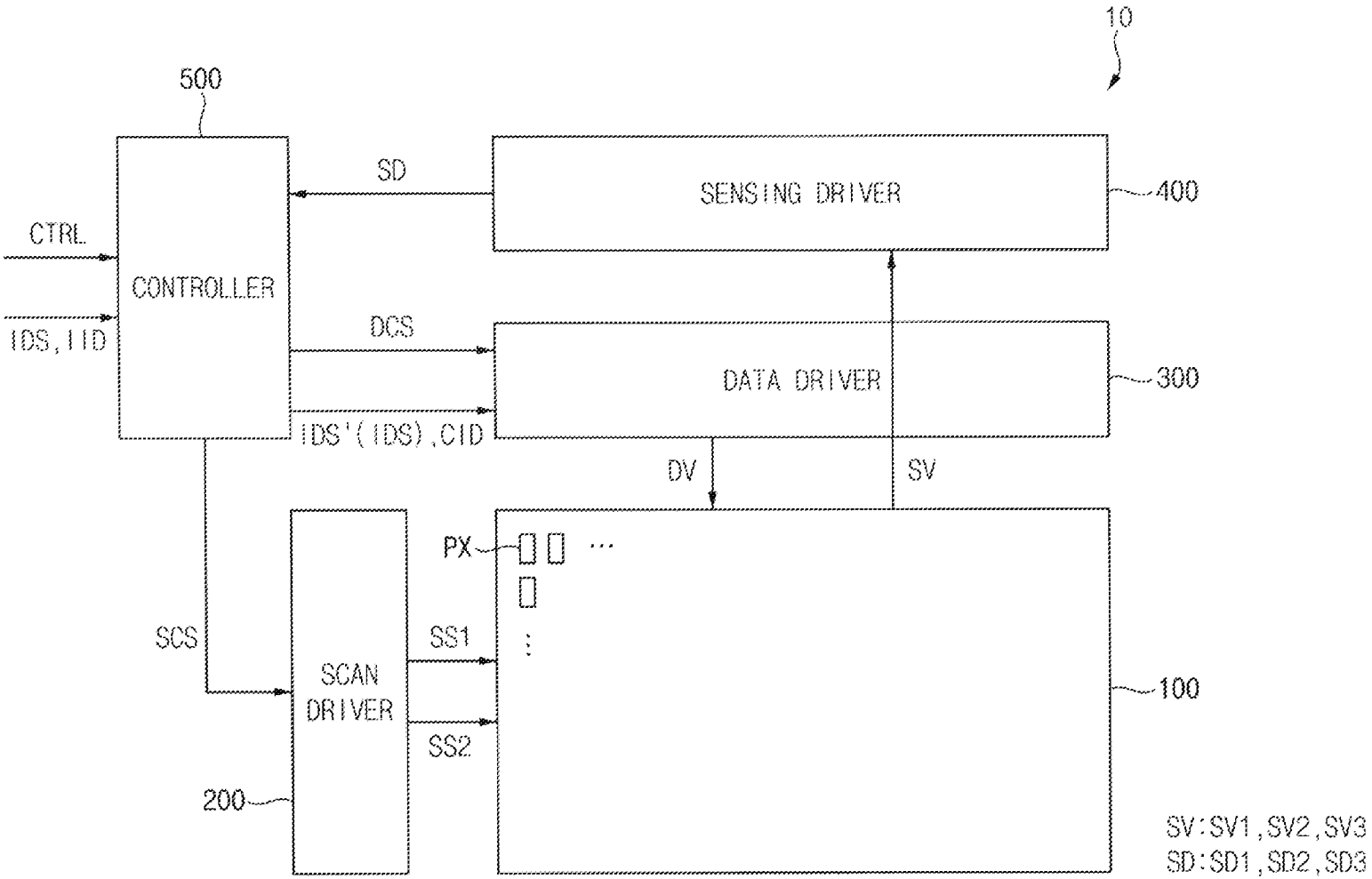
FIG. 1 is a block diagram illustrating a display device according to an embodiment.

FIG. 1 is a block diagram illustrating a display device 10 according to an embodiment.

Referring to FIG. 1, the display device 10 may include a display panel 100, a scan driver 200, a data driver 300, a sensing driver 400, and a controller 500.

The display panel 100 may include pixels PX. The pixels PX may be arranged in a substantially matrix form in the display panel 100. The display panel 100 may receive first scan signals SS1 and second scan signals SS2 from the scan driver 200, and may receive data voltages DV from the data driver 300. Each of the pixels PX may emit light based on the first scan signal SS1, the second scan signal SS2, and the data voltage DV.

Each of the pixels PX may include a light emitting diode ("LED"). In an embodiment, each of the pixels PX may include an organic light emitting diode ("OLED"), and the display panel 100 may be an organic light emitting display panel. In another embodiment, each of the pixels PX may include an inorganic light emitting diode, a quantum dot light emitting diode, or the like.

The scan driver 200 may receive a scan control signal SCS from the controller 400. The scan driver 200 may generate the first scan signals SS1 and the second scan signals SS2 based on the scan control signal SCS. The scan driver 200 may provide the first scan signals SS1 and the second scan signals SS2 to the display panel 100.

The data driver 300 may receive a data control signal DCS and compensated image data CID from the controller 400. The data driver 300 may generate the data voltages DV based on the data control signal DCS and the compensated image data CID. The data driver 300 may provide the data voltages DV to the display panel 100.

The sensing driver 400 may receive sensing voltages SV from the display panel 100. The sensing driver 400 may generate sensing data SD based on the sensing voltages SV. The sensing driver 400 may provide the sensing data SD to the controller 500.

The controller 500 (e.g., a timing controller ("T-CON")) may receive input image data IID and a control signal CTRL from an external host processor (e.g., a graphic processing unit ("GPU") or a graphic card). The controller 500 may generate the scan control signal SCS, the data control signal DCS, and the compensated image data CID based on the input image data IID and the control signal CTRL. The controller 500 may provide the scan control signal SCS to the scan driver 200, and may provide the data control signal DCS and the compensated image data CID to the data driver 300.

The sensing driver 400 may generate first sensing data SD1 based on first sensing voltages SV1 with respect to threshold voltages of driving transistors of the pixels PX which are sensed using image data for sensing IDS during a first sensing period after power-off of the display device 10. The controller 500 may generate first compensation data for compensating degraded threshold voltages of the driving transistors of the pixels PX based on the first sensing data SD1.

The sensing driver 400 may generate second sensing data SD2 based on second sensing voltages SV2 with respect to mobilities of the driving transistors of the pixels PX which are sensed using image data for sensing IDS' compensated based on the first compensation data during the first sensing period. The controller 500 may generate second compensation data for compensating degraded mobilities of the driving transistors of the pixels PX based on the second sensing data SD2.

The sensing driver 400 may generate third sensing data SD3 based on third sensing voltages SV3 with respect to mobility change amounts of the driving transistors of the pixels PX which are sensed using image data for sensing IDS' compensated based on the first compensation data and the second compensation data during a second sensing period during image display of the display device 10. The controller 500 may generate third compensation data for compensating the mobility change amounts of the driving transistors of the pixels PX based on the third sensing data SD3. Since the mobility change amounts of the driving transistors of the pixels PX are sensed using the image data for sensing IDS' compensated based on the first compensation data and the second compensation data during the second sensing period, the mobility change amounts of the driving transistors of the pixels during the image display may be accurately sensed.

The controller 500 may compensate the input image data IID based on the first compensation data, the second compensation data, and the third compensation data to generate the compensated image data CID. The first compensation data may compensate only the degraded threshold voltages of the driving transistors of the pixels PX, the second compensation data may compensate only the degraded mobilities of the driving transistors of the pixels PX, and the third compensation data may compensate only the mobility change amounts of the driving transistors of the pixels PX, so that the threshold voltages and the mobilities of the driving transistors of the pixels PX may be accurately compensated.

Figure 2:
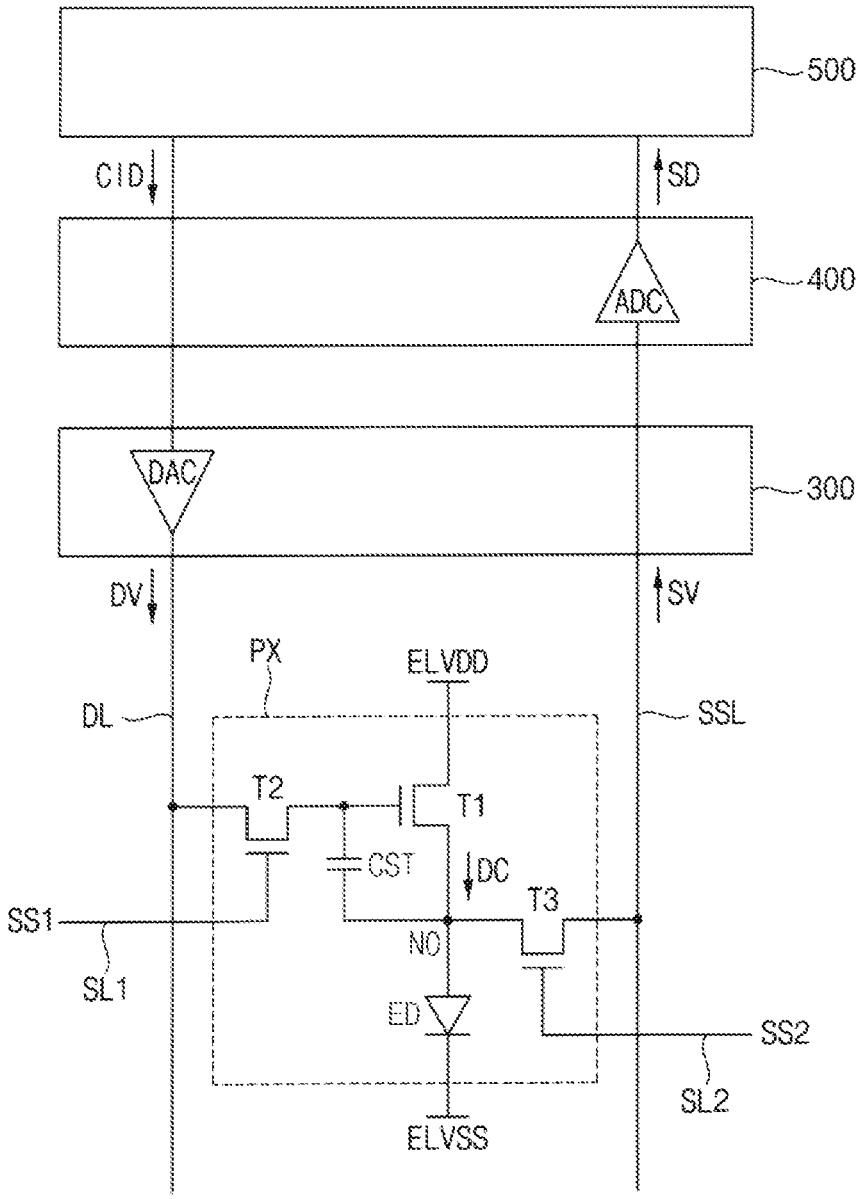
FIG. 2 is a diagram illustrating a pixel, a data driver, a sensing driver, and a controller included in the display device in FIG. 1.

FIG. 2 is a diagram illustrating the pixel PX, the data driver 300, the sensing driver 400, and the controller 500 included in the display device 10 in FIG. 1.

Referring to FIGS. 1 and 2, the pixel PX may be connected to a first scan line SL1, a second scan line SL2, a data line DL, and a sensing line SSL. The pixel PX may include a driving transistor T1, a switching transistor T2, a sensing transistor T3, a storage capacitor CST, and a light emitting diode ED.

The switching transistor T2 may transmit the data voltage DV transmitted from the data line DL in response to the first scan signal SS1 transmitted from the first scan line SL1.

The driving transistor T1 may generate a driving current DC flowing from a line transmitting a first power voltage ELVDD to a line transmitting a second power voltage ELVSS based on the data voltage DV.

The storage capacitor CST may store the data voltage DV.

The light emitting diode ED may emit light based on the driving current DC.

The sensing transistor T3 may transmit the sensing voltage SV to the sensing line SSL in response to the second scan signal SS2 transmitted from the second scan line SL2. The sensing voltage SV may be a voltage at a node NO between the driving transistor T1 and the light emitting diode ED.

The data driver 300 may generate the data voltage DV based on the compensated image data CID provided from the controller 500. The data driver 300 may include a digital-to-analog converter ("DAC") for converting the compensated image data CID into the data voltage DV. The data driver 300 may provide the data voltage DV to the data line DL.

The sensing driver 400 may generate the sensing data SD based on the sensing voltage SV provided from the sensing line SSL. The sensing driver 400 may include an analog-to-digital converter ("ADC") for converting the sensing voltage SV into the sensing data SD. The sensing driver 400 may provide the sensing data SD to the controller 500.

Figure 3:
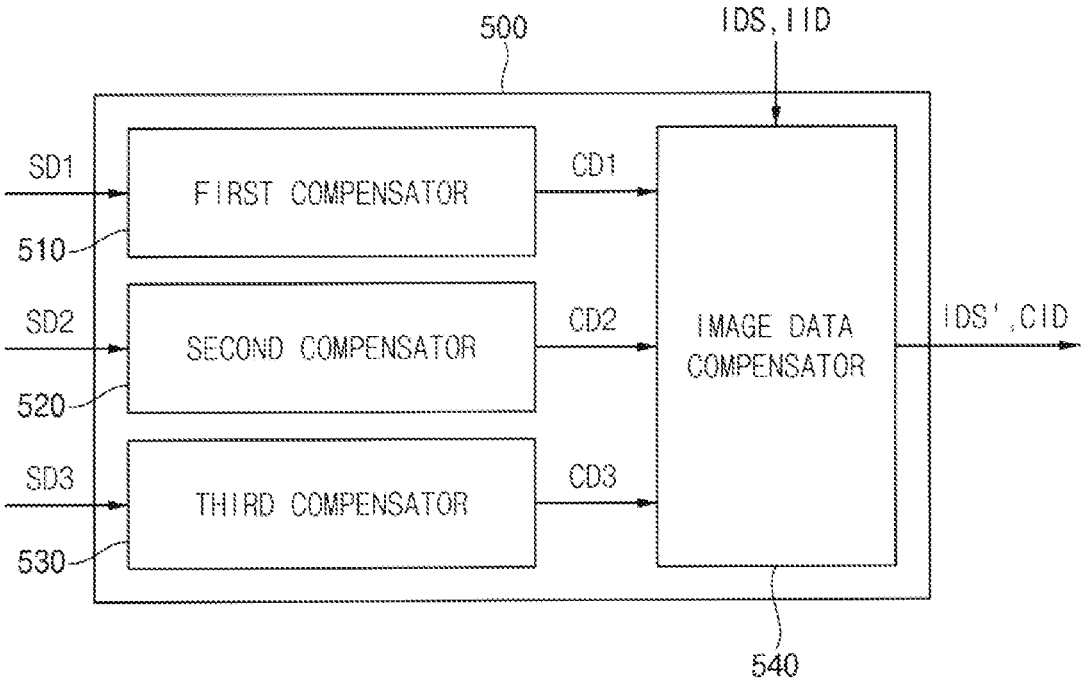
FIG. 3 is a block diagram illustrating a controller included in the display device in FIG. 1.

FIG. 3 is a block diagram illustrating the controller 500 included in the display device 10 in FIG. 1.

Referring to FIGS. 1 and 3, the controller 500 may include a first compensator 510, a second compensator 520, a third compensator 530, and an image data compensator 540.

The first compensator 510 may generate the first compensation data CD1 based on the first sensing data SD1. The first compensation data CD1 may include offsets with respect to the data voltages DV. The image data compensator 540 may compensate the image data for sensing IDS based on the first compensation data CD1 to generate the compensated image data for sensing IDS'. The compensated image data for sensing IDS' may compensate the degraded threshold voltages of the driving transistors of the pixels PX.

The second compensator 520 may generate the second compensation data CD2 based on the second sensing data SD2. The second compensation data CD2 may include gains with respect to the data voltages DV. The image data compensator 540 may compensate the image data for sensing IDS based on the first compensation data CD1 and the second compensation data CD2 to generate compensated image data for sensing IDS'. The compensated image data for sensing IDS' may compensate the degraded threshold voltages and the degraded mobilities of the driving transistors of the pixels PX.

The third compensator 530 may generate the third compensation data CD3 based on the third sensing data SD3. The third compensation data CD3 may include gains with respect to the data voltages DV. The image data compensator 540 may compensate the input image data IID based on the first compensation data CD1, the second compensation data CD2, and the third compensation data CD3 to generate the compensated image data CID. The compensated image data CID may compensate the degraded threshold voltages, the degraded mobilities, and the mobility change amounts of the driving transistors of the pixels PX.

Figure 4:
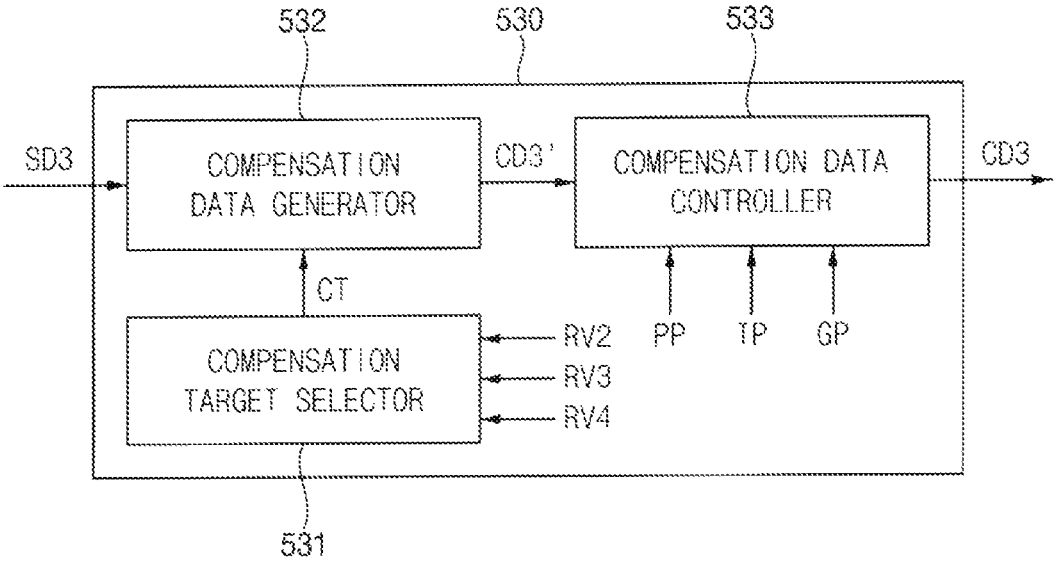
FIG. 4 is a block diagram illustrating a third compensator included in the controller in FIG. 3.

FIG. 4 is a block diagram illustrating the third compensator 530 included in the controller 500 in FIG. 3.

Referring to FIGS. 1, 3, and 4, the third compensator 530 may include a compensation target selector 531, a compensation data generator 532, and a compensation data controller 533.

The compensation target selector 531 may select a compensation target CT. The compensation target selector 531 may select one of a representative value RV2 of the second sensing data SD2, a representative value RV3 of the third sensing data SD3, and a representative value RV4 of fourth sensing data as the compensation target CT. In an embodiment, the sensing driver 400 may generate the fourth sensing data based on fourth sensing voltages with respect to the mobilities of the driving transistors of the pixels PX which are sensed using the image data for sensing IDS' compensated based on the first compensation data CD1 during a third sensing period after power-on of the display device 10.

The representative value RV2 of the second sensing data SD2 may be one of a standard deviation value, an average value, a maximum value, and a minimum value of the second sensing data SD2. The representative value RV3 of the third sensing data SD3 may be one of a standard deviation value, an average value, a maximum value, and a minimum value of the third sensing data SD3. The representative value RV4 of the fourth sensing data may be one of a standard deviation value, an average value, a maximum value, and a minimum value of the fourth sensing data.

In an embodiment, the compensation target selector 531 may gradually change the compensation target CT from a first voltage level to a second voltage level during a predetermined transition time when the compensation target CT changes from the first voltage level to the second voltage level. Accordingly, the compensation target CT may smoothly change, and luminance of an image displayed by the display device 10 may smoothly change.

The compensation data generator 532 may generate a third compensation data CD3' based on the third sensing data SD3 and the compensation target CT. The third compensation data CD3' may include gains with respect to the data voltages DV.

The compensation data controller 533 may control the third compensation data CD3' based on a parameter to generate an adjusted third compensation data CD3. As the third compensation data CD3' is controlled based on the parameter, the influence of noise (e.g., noise due to power, electrical coupling, or the like) included in the third sensing data SD3 on the third compensation data CD3 may be reduced.

Figure 5:
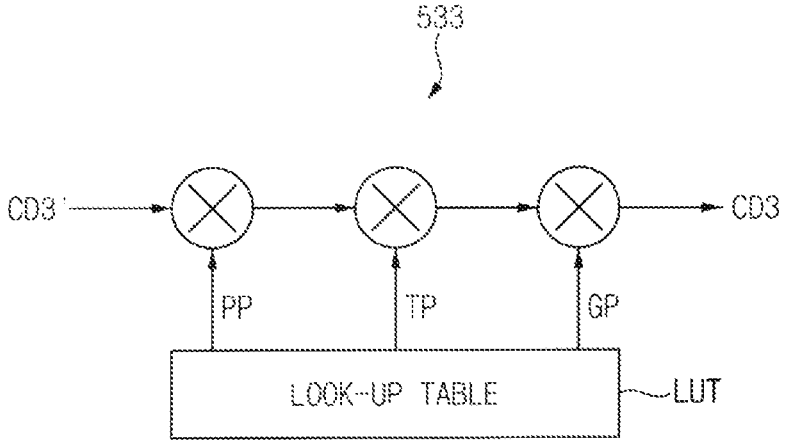
FIG. 5 is a diagram illustrating a compensation data controller included in the third compensator in FIG. 4.

FIG. 5 is a diagram illustrating the compensation data controller 533 included in the third compensator 530 in FIG. 4.

Referring to FIGS. 1, 3, 4, and 5, the compensation data controller 533 may multiply the gains of the third compensation data CD3' by at least one of a panel parameter PP, a temperature parameter TP, and a grayscale parameter GP. In an embodiment, the compensation data controller 533 may multiply the gains of the third compensation data CD3' by the panel parameter PP, the temperature parameter TP, and the grayscale parameter GP to generate the adjusted third compensation data CD3.

The panel parameter PP may be determined according to the type of the display panel 100 (or the display device 10). In an embodiment, the panel parameter PP may be determined according to the size of the display panel 100 (or the display device 10). As the gains of the third compensation data CD3' is multiplied by the panel parameter PP, the influence of the size of the display panel 100 on the third compensation data CD3 may be reduced.

The temperature parameter TP may be determined according to the temperature of the display panel 100 (or the display device 10). For example, the temperature of the display panel 100 may be collected by a temperature sensor. As the gains of the third compensation data CD3' is multiplied by the temperature parameter TP, the influence of the temperature of the display panel 100 on the third compensation data CD3 may be reduced.

The grayscale parameter GP may be determined according to grayscales of the input image data IID (or luminance of an image displayed by the display device 10). In an embodiment, the grayscale parameter GP may be determined according to a representative grayscale of the input image data IID. For example, the representative grayscale of the input image data IID may be one of a standard deviation value, an average value, a maximum value, and a minimum value of the grayscales of the input image data IID. As the gains of the third compensation data CD3' is multiplied by the grayscale parameter GP, the influence of the input image data IID on the third compensation data CD3 may be reduced.

In an embodiment, the parameter may be stored in a look-up table LUT. For example, the look-up table LUT may include at least one of the panel parameter PP, the temperature parameter TP, and the grayscale parameter GP.

Figure 6:
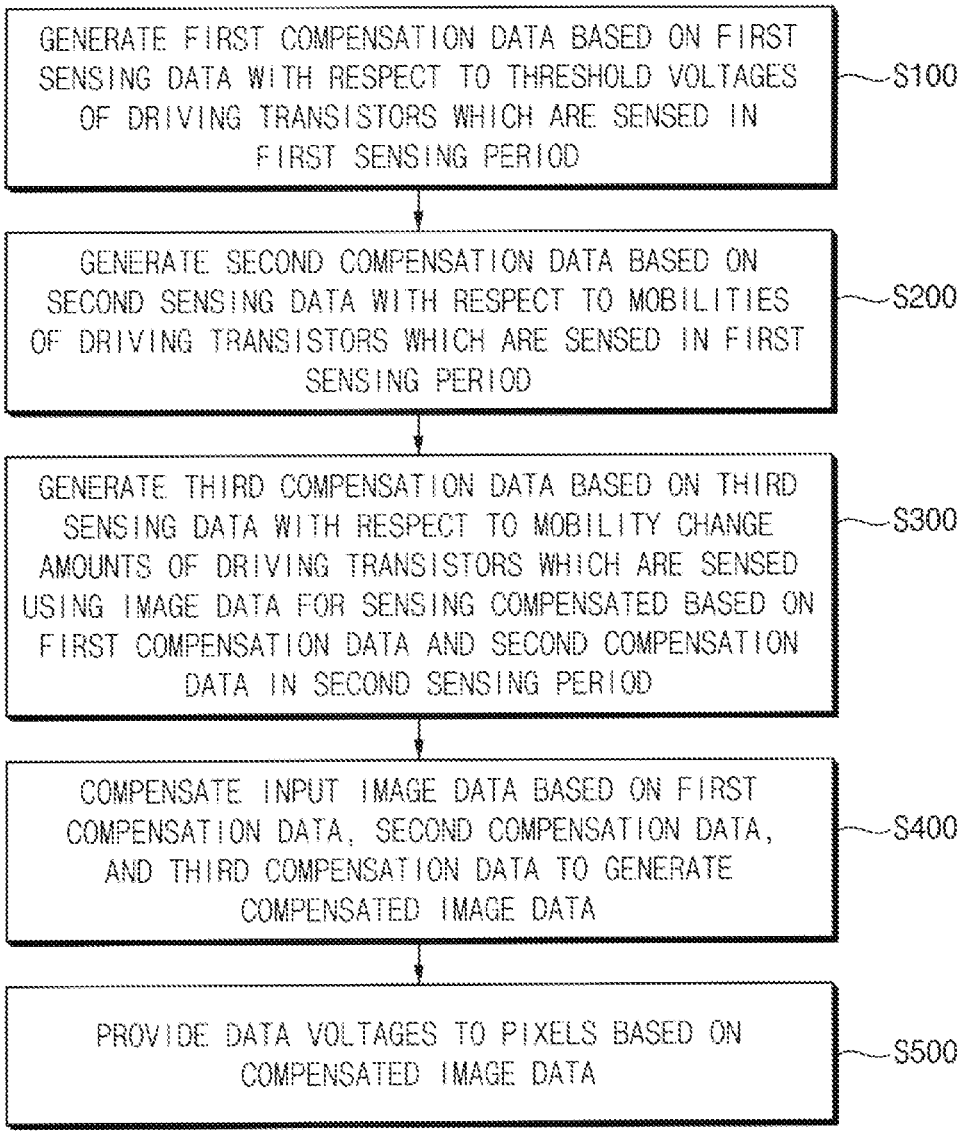
FIG. 6 is a flowchart illustrating a method of driving a display device according to an embodiment.
Figure 7:
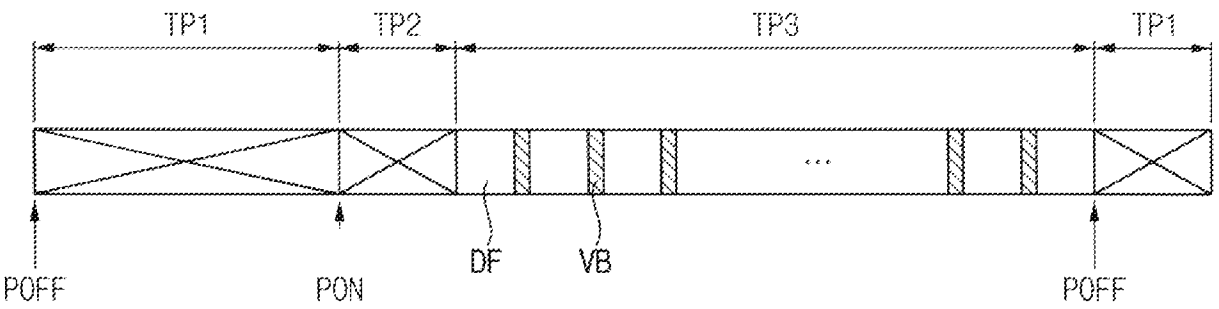
FIG. 7 is a diagram for describing sensing periods according to an embodiment.
Figure 8:
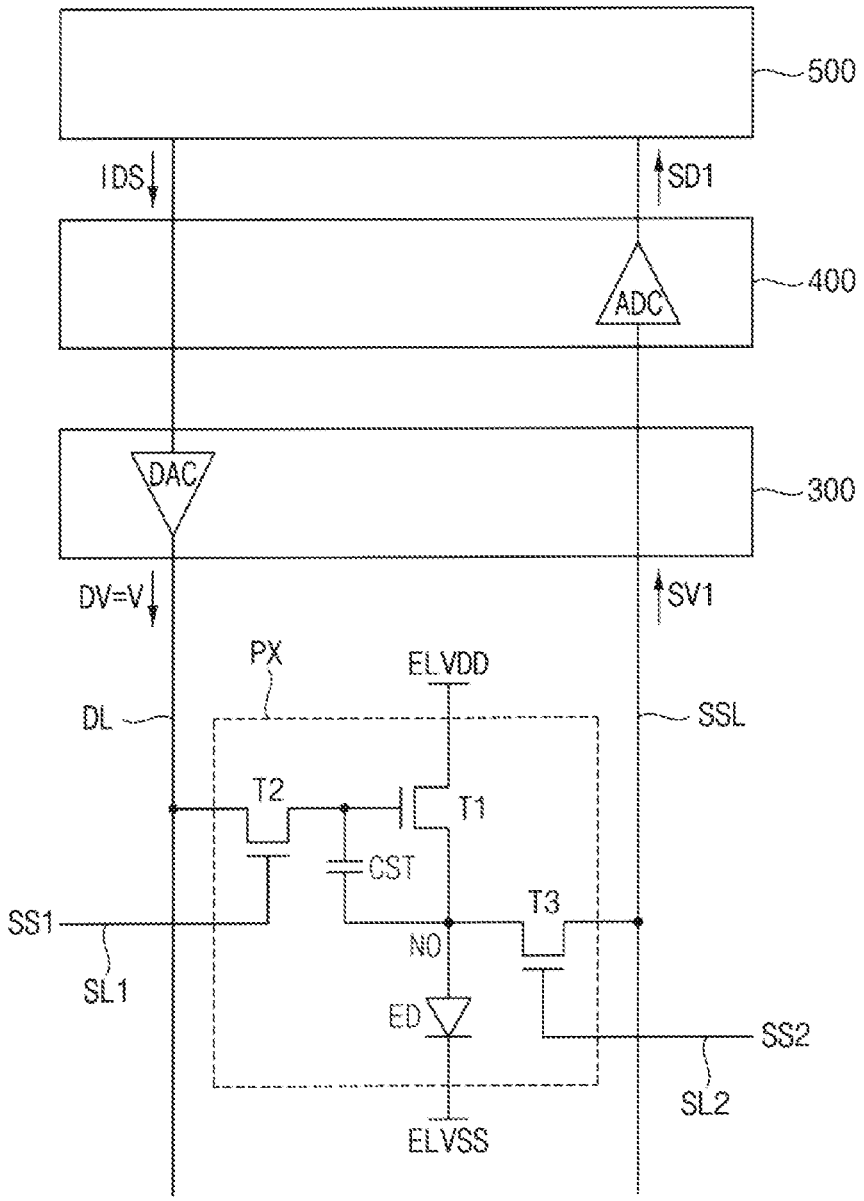
FIG. 8 is a diagram for describing sensing of a threshold voltage of a driving transistor during a first sensing period.

FIG. 6 is a flowchart illustrating a method of driving a display device 10 according to an embodiment. FIG. 7 is a diagram for describing sensing periods according to an embodiment. FIG. 8 is a diagram for describing sensing of the threshold voltage of the driving transistor T1 during the first sensing period.

Referring to FIGS. 3, 6, 7, and 8, the controller 500 may generate the first compensation data CD1 based on the first sensing data SD1 with respect to the threshold voltages of the driving transistors T1 of the pixels PX which are sensed using the image data for sensing IDS during the first sensing period (S100).

Time periods in which the display device 10 is driven may include a first time period TP1, a second time period P2, and a third time period P3. The first time period TP1 may be from a power-off time POFF of the display device 10 to a power-on time PON of the display device 10, and the first sensing period may be within the first time period TP1. The second time period TP2 may be from the power-on time PON of the display device 10 to an image display time of the display device 10, and the third sensing period may be within the second time period TP2. The third time period TP3 may be from the image display time of the display device 10 to the power-off time POFF of the display device 10. The third time period TP3 may include image display frame periods DF and vertical blank periods VB which are alternately repeated with each other, and the second sensing period may be within the vertical blank period VB.

The controller 500 may provide the image data for sensing IDS to the data driver 300 during the first sensing period, and the data driver 300 may provide data voltages DV to the pixels PX based on the image data for sensing IDS. The data voltages DV may have data voltage values for initial sensing (V).

The pixels PX may provide the first sensing voltages SV1 to the sensing driver 400 based on the data voltages DV, and the sensing driver 400 may provide the first sensing data SD1 to the controller 500 based on the first sensing voltages SV1. The first sensing voltages SV1 may include information on the threshold voltages of the driving transistors T1 of the pixels PX at the power-off time POFF.

The first compensator 510 of the controller 500 may generate the first compensation data CD1 for compensating the degraded threshold voltages of the driving transistors T1 of the pixels PX based on the first sensing data SD1 including the information on the threshold voltages of the driving transistors T1 of the pixels PX at the power-off time POFF. The first compensation data CD1 may include offsets for compensating the degraded threshold voltages of the driving transistors T1 of the pixels PX at the power-off time POFF.

Figure 9:
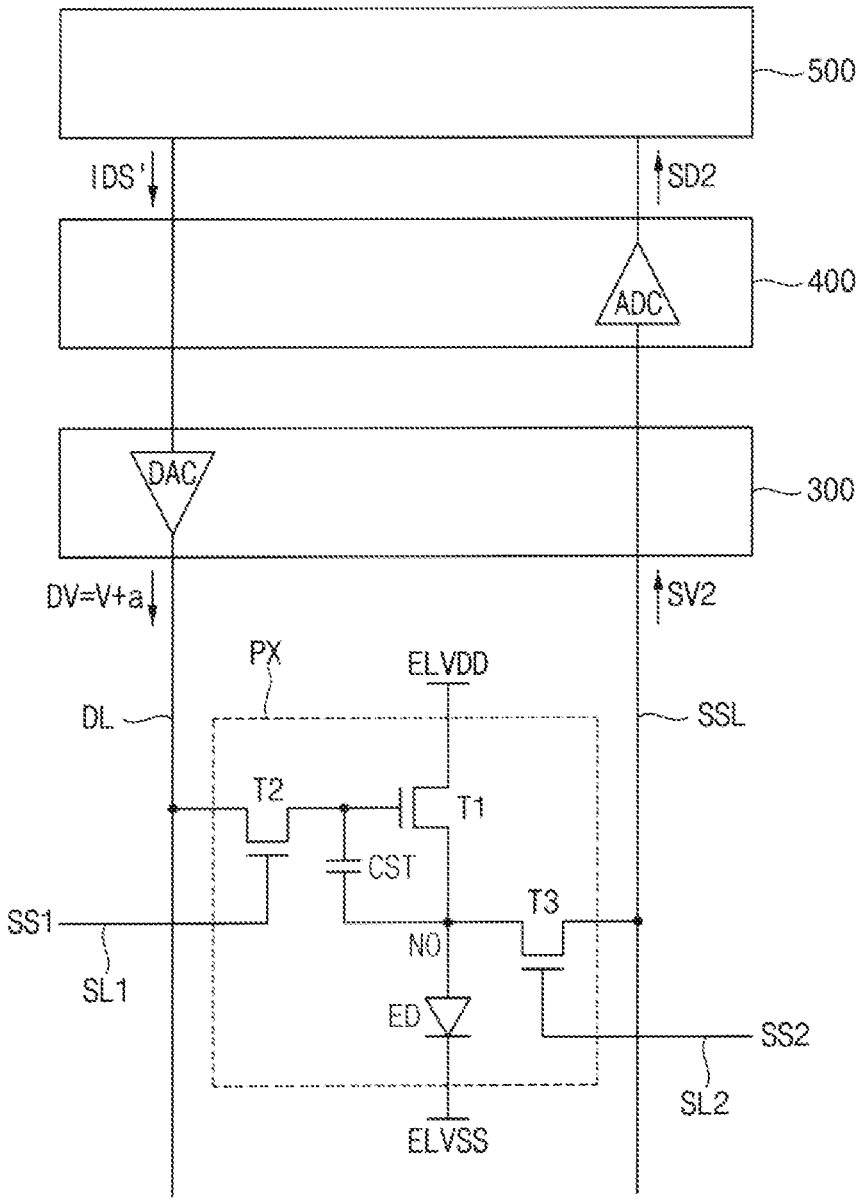
FIG. 9 is a diagram for describing sensing of a mobility of a driving transistor during a first sensing period.

FIG. 9 is a diagram for describing sensing of the mobility of the driving transistor T1 in the first sensing period.

Referring to FIGS. 3, 6, 7, and 9, the controller 500 may generate the second compensation data CD2 based on the second sensing data SD2 with respect to the mobilities of the driving transistors T1 of the pixels PX which are sensed using the image data for sensing IDS' compensated based on the first compensation data CD1 during the first sensing period (S200).

The image data compensator 540 of the controller 500 may compensate the image data for sensing IDS based on the first compensation data CD1 to generate the compensated image data for sensing IDS'.

The controller 500 may provide the compensated image data for sensing IDS' to the data driver 300 during the first sensing period, and the data driver 300 may provide the data voltages DV to the pixels PX based on the compensated image data for sensing IDS'. In an embodiment, the data voltage DV may have a value (V+a) obtained by adding an offset (a) for compensating the degraded threshold voltage of the driving transistor T1 at the power-off time POFF to the data voltage value for initial sensing (V).

The pixels PX may provide the second sensing voltages SV2 to the sensing driver 400 based on the data voltages DV, and the sensing driver 400 may provide the second sensing data SD2 to the controller 500 based on the second sensing voltages SV2. The second sensing voltages SV2 may include information on the mobilities of the driving transistors T1 of the pixels PX at the power-off time POFF.

Since the data voltages DV for compensating the degraded threshold voltages of the driving transistors T1 at the power-off time POFF are provided to the pixels PX, the second sensing voltages SV2 may include only the information on the degraded mobilities of the driving transistors T1 of the pixels PX at the power-off time POFF except for the information on the degraded threshold voltages of the driving transistors T1 of the pixels PX at the power-off time POFF.

The second compensator 520 of the controller 500 may generate the second compensation data CD2 for compensating the degraded mobilities of the driving transistors T1 of the pixels PX based on the second sensing data SD2 including the information on the mobilities of the driving transistors T1 of the pixels PX at the power-off time POFF. The second compensation data CD2 may include gains for compensating the degraded mobilities of the driving transistors T1 of the pixels PX at the power-off time POFF.

Figure 10:
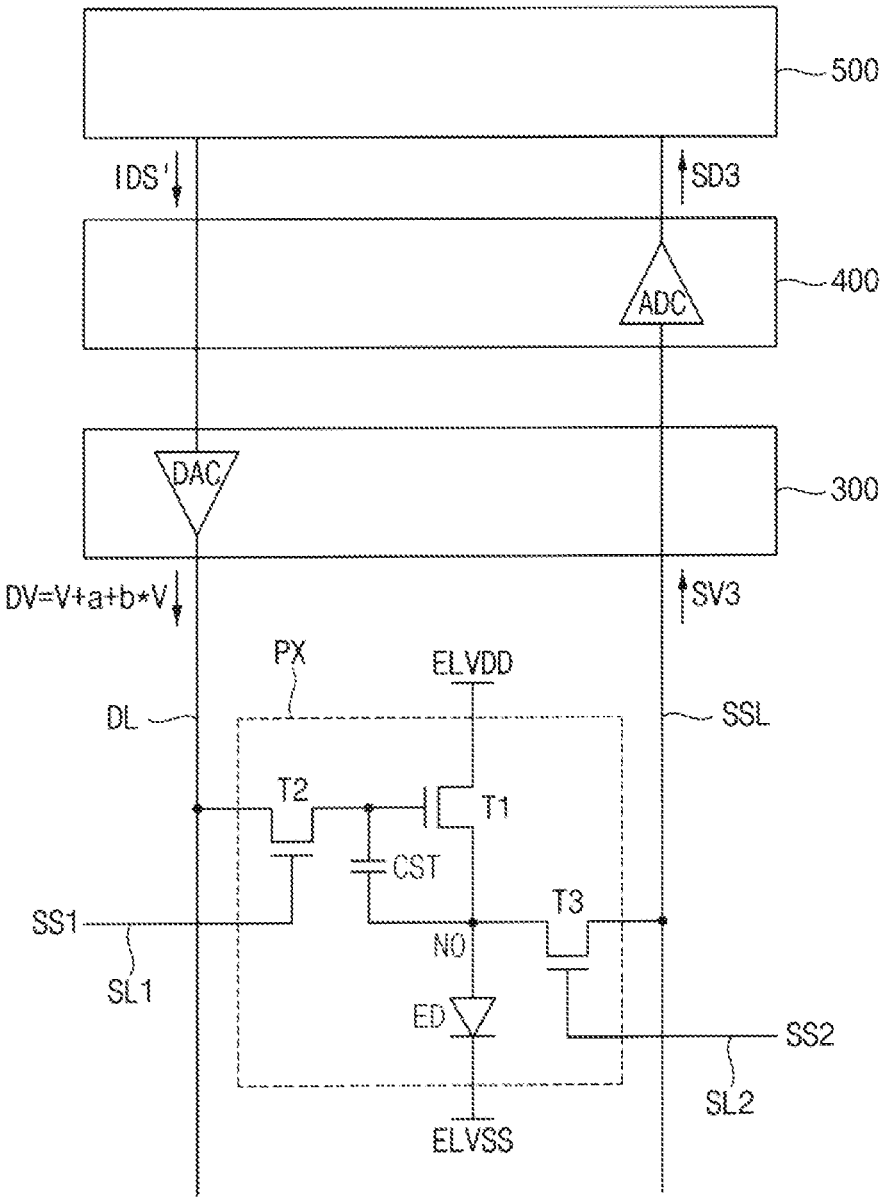
FIG. 10 is a diagram for describing sensing of a mobility change amount of a driving transistor during a second sensing period.
Figure 11:
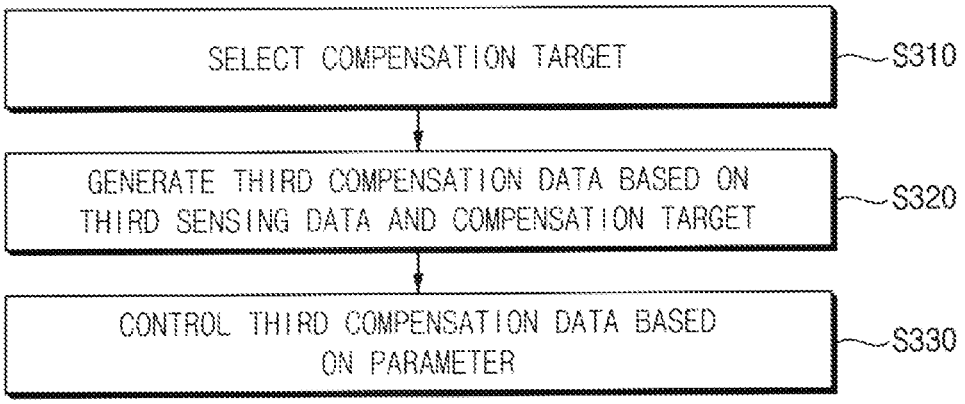
FIG. 11 is a flowchart illustrating a method of driving a third compensator according to an embodiment.
Figure 12:
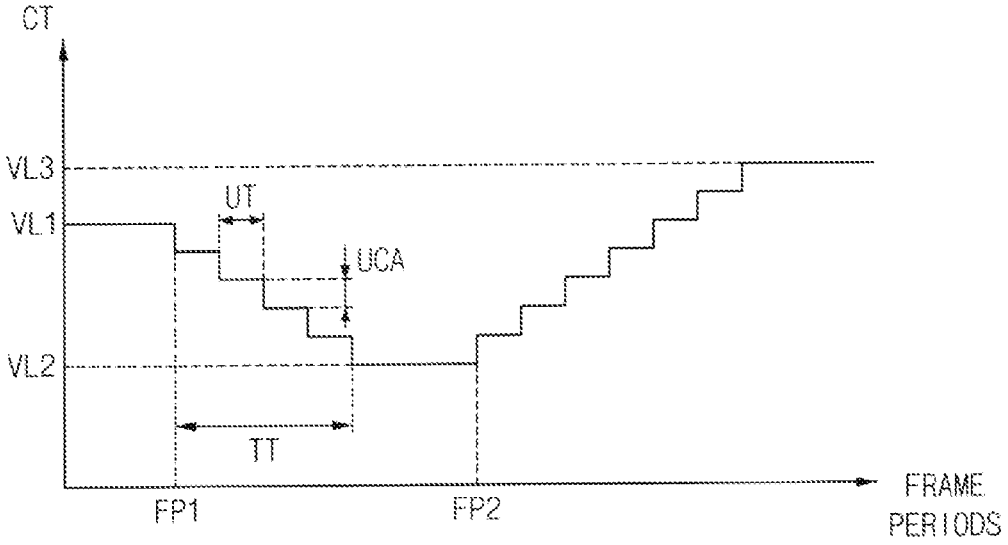
FIG. 12 is a diagram for describing selection of a compensation target according to an embodiment.
Figure 13:
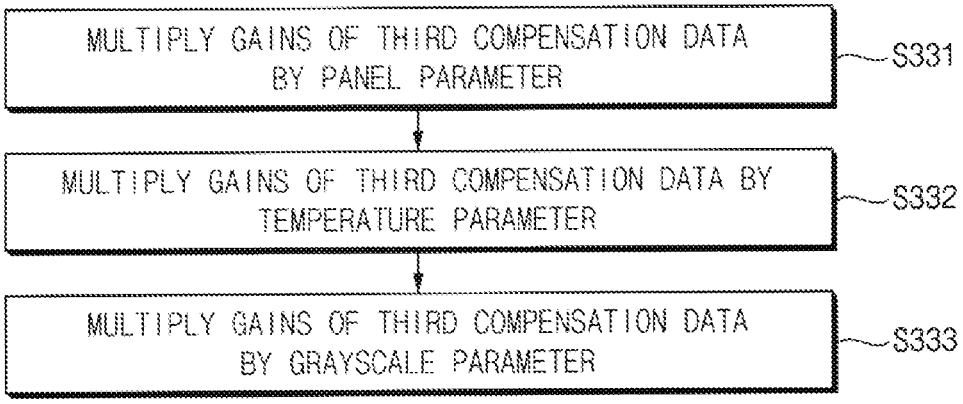
FIG. 13 is a flowchart illustrating a method of driving a compensation data controller according to an embodiment.

FIG. 10 is a diagram for describing sensing of the mobility change amount of the driving transistor T1 during the second sensing period. FIG. 11 is a flowchart illustrating a method of driving the third compensator 530 according to an embodiment. FIG. 12 is a diagram for describing selection of the compensation target CT according to an embodiment. FIG. 13 is a flowchart illustrating a method of driving the compensation data controller 533 according to an embodiment.

Referring to FIGS. 3, 4, 5, 6, 7, 10, 11, 12, and 13, the controller 500 may generate the third compensation data CD3 based on the third sensing data SD3 with respect to the mobility change amounts of the driving transistors T1 of the pixels PX which are sensed using the image data for sensing (IDS') compensated based on the first compensation data CD1 and the second compensation data CD2 during the second sensing period (S300).

The image data compensator 540 of the controller 500 may compensate the image data for sensing IDS based on the first compensation data CD1 and the second compensation data CD2 to generate the compensated image data for sensing IDS'.

The controller 500 may provide the compensated image data for sensing IDS' to the data driver 300 during the second sensing period, and the data driver 300 may provide the data voltages DV to the pixels PX based on the compensated image data for sensing IDS'. In an embodiment, the data voltage DV may have a value (V+a+b*V) obtained by adding an offset (a) for compensating the degraded threshold voltage of the driving transistor T1 at the power-off time POFF and a product of a gain (b) for compensating the degraded mobility of the driving transistor T1 at the power-off time POFF and the data voltage value for initial sensing (V) to the data voltage value for initial sensing (V).

The pixels PX may provide the third sensing voltages SV3 to the sensing driver 400 based on the data voltages DV, and the sensing driver 400 may provide the third sensing data SD3 to the controller 500 based on the third sensing voltages SV3. The third sensing voltages SV3 may include information on the mobility change amounts of the driving transistors T1 of the pixels PX during the image display. The mobilities of the driving transistors T1 of the pixels PX may change according to environmental changes (e.g., temperature change, luminance change, etc.) due to the image display.

Since the data voltages DV for compensating the degraded threshold voltages of the driving transistors T1 at the power-off time POFF and for compensating the degraded mobilities of the driving transistors T1 at the power-off time POFF are provided to the pixels PX, the third sensing voltages SV3 may include only the information on the mobility change amounts of the driving transistors T1 of the pixels PX during the image display except for the information on the degraded threshold voltages of the driving transistors T1 of the pixels PX at the power-off time POFF and the information on the degraded mobilities of the driving transistors T1 of the pixels PX at the power-off time POFF.

The third compensator 530 of the controller 500 may generate the third compensation data CD3 for compensating the mobility change amounts of the driving transistors T1 of the pixels PX based on the third sensing data SD3 including the information on the mobility change amounts of the driving transistors T1 of the pixels PX during the image display.

The compensation target selector 531 of the third compensator 530 may select the compensation target CT (S310). The compensation target selector 531 may select one of the representative value RV2 of the second sensing data SD2, the representative value RV3 of the third sensing data SD3, and the representative value RV4 of the fourth sensing data as the compensation target CT.

In an embodiment, the compensation target selector 531 may gradually change the compensation target CT during a predetermined transition time when the compensation target CT changes. For example, the compensation target selector 531 may gradually change the compensation target CT from a first voltage level VL1 to a second voltage level VL2 during a predetermined transition time TT when the compensation target CT changes from the first voltage level VL1 to the second voltage level VL2 in a first frame period FP1. For example, the compensation target selector 531 may store a unit time UT and a unit change amount UCA, and may change the compensation target CT by the unit change amount UCA for every unit time UT. Further, the compensation target selector 531 may gradually change the compensation target CT from the second voltage level VL2 to a third voltage level VL3 in a predetermined transition time when the compensation target CT changes from the second voltage level VL2 to the third voltage level VL3 in a second frame period FP2. Accordingly, the compensation target CT may smoothly change, and luminance of an image displayed by the display device 10 may smoothly change.

The compensation data generator 532 may generate the third compensation data CD3' based on the third sensing data SD3 and the compensation target CT (S320). The third compensation data CD3' may include gains for compensating the mobility change amounts of the driving transistors T1 of the pixels PX during the image display.

The compensation data controller 533 may control the third compensation data CD3' based on the parameter to generate the adjusted third compensation data CD3 (S330). The compensation data controller 533 may multiply the gains of the third compensation data CD3' by at least one of the panel parameter PP, the temperature parameter TP, and the grayscale parameter GP. In an embodiment, the compensation data controller 533 may multiply the gains of the third compensation data CD3' by the panel parameter PP (S331), may multiply the gains of the third compensation data CD3' by the temperature parameter TP (S332), and may multiply the gains of the third compensation data CD3' by the grayscale parameter GP (S333).

Referring to FIGS. 3 and 6, the controller 500 may compensate the input image data IID based on the first compensation data CD1, the second compensation data CD2, and the third compensation data CD3 to generate the compensated image data CID (S400).

Figure 14:
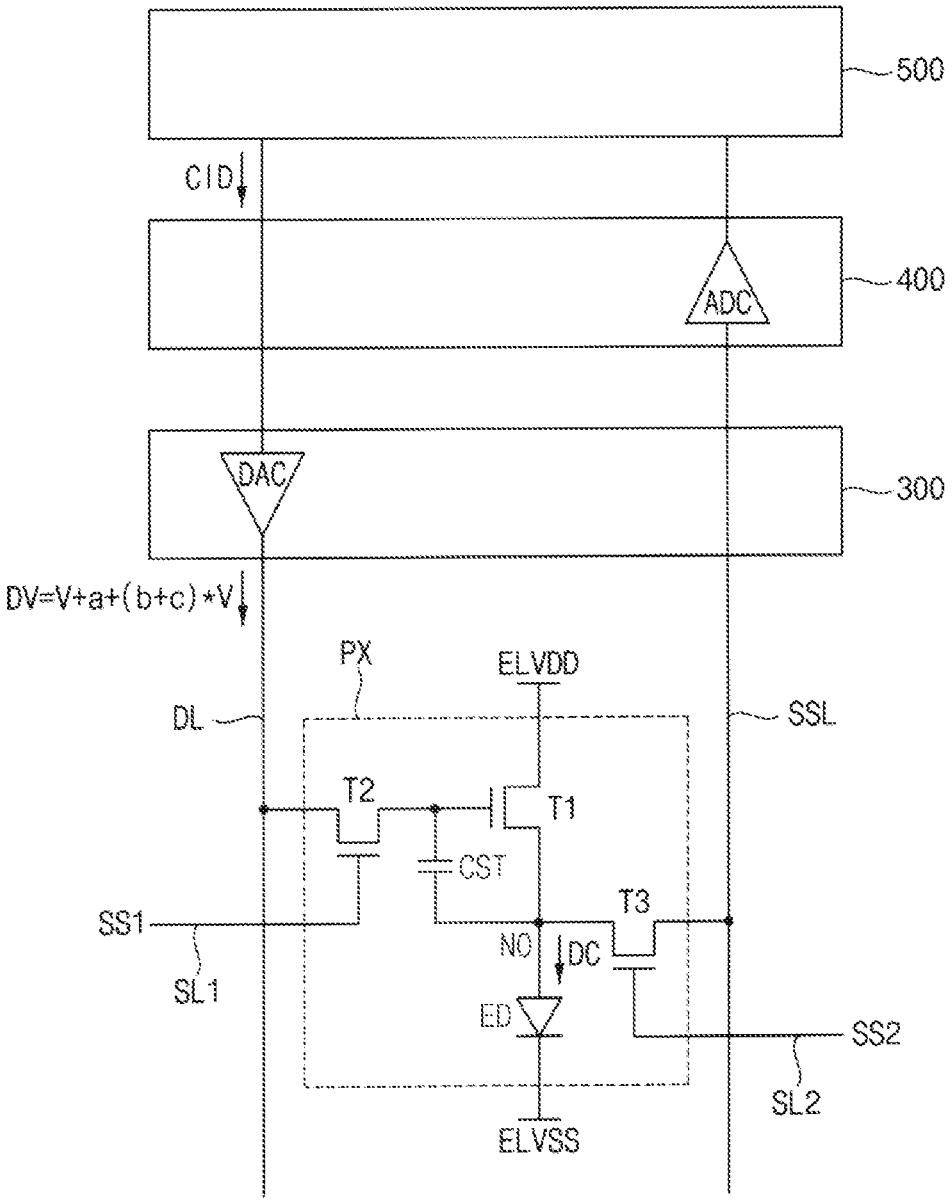
FIG. 14 is a diagram for describing image display based on compensated image data.

FIG. 14 is a diagram for describing image display based on the compensated image data CID.

Referring to FIGS. 1, 3, 7, and 14, the data driver 300 may provide data voltages DV to the pixels PX based on the compensated image data CID (S500). In an embodiment, the data voltage DV may have a value (V+a+(b+c)*V) obtained by adding an offset (a) for compensating the degraded threshold voltage of the driving transistor T1 at the power-off time POFF, a product of a gain (b) for compensating the degraded mobility of the driving transistor T1 at the power-off time POFF and the data voltage value for initial sensing (V), and a product of a gain (c) for compensating the mobility change amount of the driving transistor T1 in the image display and the data voltage value for initial sensing (V) to the data voltage value for initial sensing (V).

The driving transistors T1 of the pixels PX may provide driving currents DC to the light emitting diodes ED of the pixels PX based on the data voltages DV, and the light emitting diodes ED may emit light based on the driving currents DC.

Figure 15:
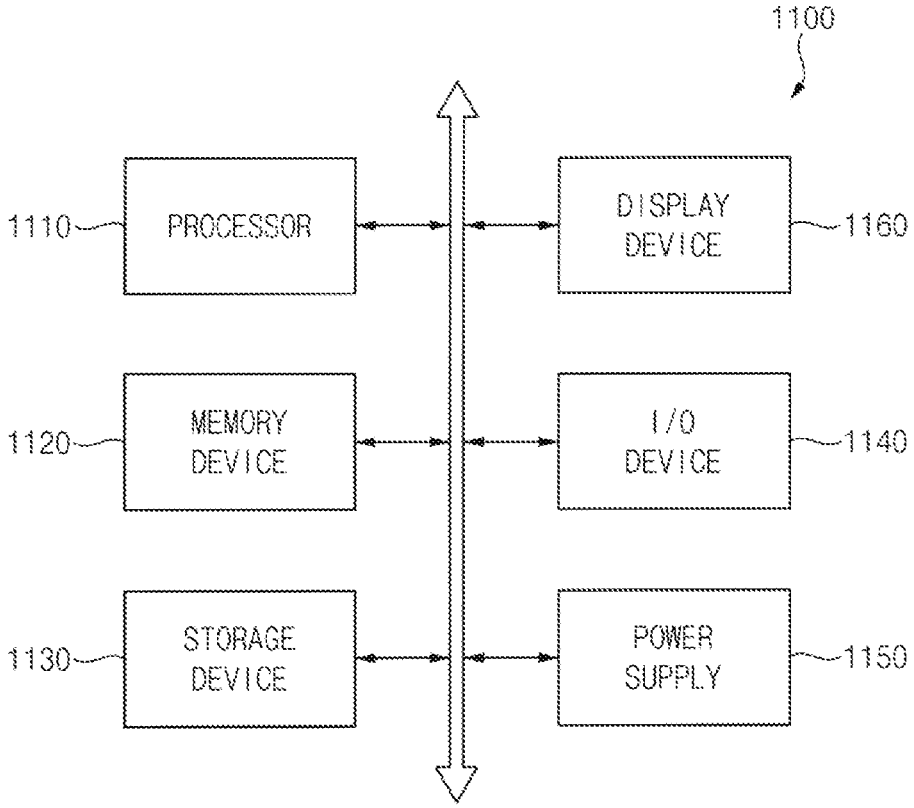
FIG. 15 is a block diagram illustrating an electronic apparatus including a display device according to an embodiment.

FIG. 15 is a block diagram illustrating an electronic apparatus 1100 including a display device 1160 according to an embodiment.

Referring to FIG. 15, the electronic apparatus 1100 may include a processor 1110, a memory device 1120, a storage device 1130, an input/output ("I/O") device 1140, a power supply 1150, and a display device 1160. The electronic apparatus 1100 may further include a plurality of ports for communicating with a video card, a sound card, a memory card, a universal serial bus ("USB") device, etc.

The processor 1110 may perform particular calculations or tasks. In an embodiment, the processor 1110 may be a microprocessor, a central processing unit ("CPU"), or the like. The processor 1110 may be coupled to other components via an address bus, a control bus, a data bus, or the like. In an embodiment, the processor 1110 may be coupled to an extended bus such as a peripheral component interconnection ("PCI") bus.

The memory device 1120 may store data for operations of the electronic apparatus 1100. In an embodiment, the memory device 1120 may include a non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc., and/or a volatile memory device such as a dynamic random access memory ("DRAM") device, a static random access memory ("SRAM") device, a mobile DRAM device, etc.

The storage device 1130 may include a solid state drive ("SSD") device, a hard disk drive ("HDD") device, a CD-ROM device, or the like. The I/O device 1140 may include an input device such as a keyboard, a keypad, a touchpad, a touch-screen, a mouse device, etc., and an output device such as a speaker, a printer, etc. The power supply 1150 may provide power for operations of the electronic apparatus 1100. The display device 1160 may be coupled to other components via the buses or other communication links.

In the display device 1160, the first compensation data for compensating degraded threshold voltages of the driving transistors and the second compensation data for compensating degraded mobilities of the driving transistors may be generated based on the first sensing data with respect to the threshold voltages of the driving transistors which are sensed in the first sensing period and the second sensing data with respect to the mobilities of the driving transistors which are sensed in the first sensing period, and the third compensation data for compensating the mobility change amounts of the driving transistors may be generated based on the third sensing data with respect to the mobility change amounts of the driving transistor which are sensed using the image data for sensing compensated based on the first compensation data and the second compensation data in the second sensing period, so that the mobility change amounts of the driving transistors during the image display may be accurately sensed. Further, in the display device 1160, the input image data may be compensated based on the first compensation data, the second compensation data, and the third compensation data to generate the compensated image data, so that the threshold voltages and the mobilities of the driving transistors may be accurately compensated.

The display device and the method of driving the display device according to the embodiments may be applied to a display device included in a computer, a notebook, a mobile phone, a smart phone, a smart pad, a PMP, a PDA, an MP3 player, or the like.

Although the display devices and the methods of driving the display devices according to the embodiments have been described with reference to the drawings, the illustrated embodiments are examples, and may be modified and changed by a person having ordinary knowledge in the relevant technical field without departing from the technical spirit described in the following claims.

What is claimed is:

1. A display device comprising:

a display panel including pixels;

a controller configured to generate first compensation data based on first sensing data with respect to threshold voltages of driving transistors of the pixels which are sensed during a first sensing period after a power-off of the display device, to generate second compensation data based on second sensing data with respect to mobilities of the driving transistors of the pixels which are sensed during the first sensing period, to generate third compensation data based on third sensing data with respect to mobility change amounts of the driving transistors of the pixels which are sensed using image data for sensing compensated based on the first compensation data and the second compensation data during a second sensing period during an image display of the display device, and to compensate input image data based on the first compensation data, the second compensation data, and the third compensation data to generate compensated image data; and a data driver configured to provide a data voltage to each of the pixels based on the compensated image data, wherein:

the controller includes:

a first compensator configured to generate the first compensation data based on the first sensing data;

a second compensator configured to generate the second compensation data based on the second sensing data;

a third compensator configured to generate the third compensation data based on the third sensing data; and an image data compensator configured to compensate the image data for sensing based on the first compensation data and the second compensation data, and to compensate the input image data based on the first compensation data, the second compensation data, and the third compensation data;

the third compensator includes:

a compensation target selector configured to select a compensation target;

a compensation data generator configured to generate the third compensation data based on the third sensing data and the compensation target; and a compensation data controller configured to control the third compensation data based on a parameter; and the compensation data controller is configured to multiply gains of the third compensation data by a panel parameter determined according to a size of the display panel.

2. The display device of claim 1, wherein the mobilities of the driving transistors of the pixels which are sensed during the first sensing period are sensed using the image data for sensing compensated based on the first compensation data.

3. The display device of claim 1, wherein the compensation target selector is configured to select one of a representative value of the second sensing data, a representative value of the third sensing data, and a representative value of fourth sensing data with respect to the mobilities of the driving transistors of the pixels which are sensed using the image data for sensing during a third sensing period after a power-on of the display device as the compensation target.

4. The display device of claim 1, wherein the compensation target selector is configured to gradually change the compensation target from a first voltage level to a second voltage level in a predetermined transition time when the compensation target changes from the first voltage level to the second voltage level.

5. The display device of claim 1, wherein the compensation data controller is configured to multiply the gains of the third compensation data by a temperature parameter determined according to a temperature of the display panel.

6. The display device of claim 1, wherein the compensation data controller is configured to multiply the gains of the third compensation data by a grayscale parameter determined according to grayscales of the input image data.

7. The display device of claim 1, further comprising:

a sensing driver configured to provide the first sensing data, the second sensing data, and the third sensing data to the controller based on a sensing voltage receiving from each of the pixels.

8. The display device of claim 7, further comprising:

a scan driver configured to provide a first scan signal and a second scan signal to each of the pixels.

9. The display device of claim 8, wherein each of the pixels includes:

a switching transistor configured to transmit the data voltage from the data driver in response to the first scan signal;

a driving transistor configured to generate a driving current based on the data voltage;

a storage capacitor configured to store the data voltage;

a light emitting diode configured to emit light based on the driving current; and a sensing transistor configured to transmit the sensing voltage to the sensing driver in response to the second scan signal.

10. A method of driving a display device, the method comprising:

generating first compensation data based on first sensing data with respect to threshold voltages of driving transistors of the pixels which are sensed during a first sensing period after a power-off of the display device;

generating second compensation data based on second sensing data with respect to mobilities of the driving transistors of the pixels which are sensed during the first sensing period;

generating third compensation data based on third sensing data with respect to mobility change amounts of the driving transistors of the pixels which are sensed using image data for sensing compensated based on the first compensation data and the second compensation data during a second sensing period during an image display of the display device;

compensating input image data based on the first compensation data, the second compensation data, and the third compensation data to generate compensated image data; and providing data voltages to the pixels based on the compensated image data, wherein:

generating the third compensation data includes:

selecting a compensation target;

generating the third compensation data based on the third sensing data and the compensation target; and controlling the third compensation data based on a parameter; and controlling the third compensation data includes multiplying gains of the third compensation data by a panel parameter determined according to a size of the display device.

11. The method of claim 10, wherein the mobilities of the driving transistors of the pixels which are sensed during the first sensing period are sensed using the image data for sensing compensated based on the first compensation data.

12. The method of claim 10, wherein selecting the compensation target includes:

selecting one of a representative value of the second sensing data, a representative value of the third sensing data, and a representative value of fourth sensing data with respect to the mobilities of the driving transistors of the pixels which are sensed using the image data for sensing during a third sensing period after a power-on of the display device as the compensation target.

13. The method of claim 10, wherein selecting the compensation target includes:

gradually changing the compensation target from a first voltage level to a second voltage level in a predetermined transition time when the compensation target changes from the first voltage level to the second voltage level.

14. The method of claim 10, wherein controlling the third compensation data further includes:

multiplying the gains of the third compensation data by a temperature parameter determined according to a temperature of the display device.

15. The method of claim 10, wherein controlling the third compensation data further includes:

multiply the gains of the third compensation data by a grayscale parameter determined according to grayscales of the input image data.

* * * * *